US006896155B1

(12) United States Patent
Jones et al.

(10) Patent No.: US 6,896,155 B1
(45) Date of Patent: May 24, 2005

(54) SHOWER CURTAIN WITH REMOVABLE DISPENSING POCKETS FOR RETAINING ARTICLES USED IN THE SHOWER

(76) Inventors: Warren Jones, 4838 S. Brown Villa Cove, Murray, UT (US) 84123; Jerri Challis, 4838 S. Brown Villa Cove, Murray, UT (US) 84123

( * ) Notice: Subject to any disclaimer, the term of this patent is extended or adjusted under 35 U.S.C. 154(b) by 0 days.

(21) Appl. No.: 10/436,422

(22) Filed: May 12, 2003

(51) Int. Cl.[7] ..... A30K 3/00

(52) U.S. Cl. ..... 222/106; 222/181.1; 222/181.2; 222/482; 383/41; 383/906; 160/DIG. 6

(58) Field of Search ..... 222/92, 94, 106, 222/107, 180–181.3, 481, 482; 4/597, 605, 4/613, 614; 160/123, 127, 237, 330, DIG. 6; 383/41, 906

(56) References Cited

U.S. PATENT DOCUMENTS 2,613,368 A * 10/1952 Rosenbaum ..... 4/608
4,279,362 A * 7/1981 Pursell ..... 222/94
5,544,369 A * 8/1996 Roberts ..... 4/599
5,761,751 A * 6/1998 Morrissey ..... 4/558
5,794,819 A * 8/1998 Smith ..... 222/129
5,901,769 A * 5/1999 Farley ..... 160/123
6,065,649 A * 5/2000 Scoggins ..... 222/181.2
6,176,394 B1 * 1/2001 Shimko et al. ..... 222/92
2004/0016055 A1 * 1/2004 Lamy ..... 5/485

* cited by examiner

*Primary Examiner*—J. Casimer Jacyna
(74) *Attorney, Agent, or Firm*—Michael I. Kroll

(57) ABSTRACT

The present invention 10 discloses a standard shower curtain 12 that has a plurality of individual dispensers 14 affixed to the inner side 16 thereof. These dispensers 14 provide means to contain and dispense shampoo, conditioner, liquid soap, and other amenities thus avoiding clutter and soiling around the bathtub 18 or shower stall 20. One embodiment of the present invention 10 discloses a dispenser pocket 14 providing means to close 24 and seal the liquid contents 25 within the pocket and discloses an interlocking seal channel 24 type closing mechanism at the top 30 of the pocket. Once the pocket 14 is filled with desired liquid 25, the pocket is sealed by pressing a seal channel 24 on each side of the pocket together. A release button 26 attached to the spout 28 at the bottom of the pocket 14 provides means to dispense the liquid contents 25 from the pocket. The button 26 is depressed to allow the liquid contents 25 to be dispensed from the pocket 14 and released to stop the flow. Another embodiment is open 32 at the top and has multiple drain holes 34 disposed in the bottom.

5 Claims, 10 Drawing Sheets

SHOWER CURTAIN WITH REMOVABLE DISPENSING POCKETS FOR RETAINING ARTICLES USED IN THE SHOWER

BACKGROUND OF THE INVENTION

1. Field of the Invention

The present invention relates generally to shower organizing devices and, more specifically, to a shower curtain having a plurality of removable dispenser pockets for retaining and dispensing typical shower items such as shampoo, conditioner, body soap, razors and the like.

2. Description of the Prior Art

There are other bathroom organizer devices. While these bathroom organizers may be suitable for the purposes for which they were designed, they would not be as suitable for the purposes of the present invention, as hereinafter described.

There is currently a multitude of shower articles that are used in the bathroom and particularly in the shower area. Shampoos, conditioners, soaps, razors, washcloths and other assorted toiletries often serve to create clutter in the shower area. Containers are often knocked over and left open resulting in the contents coagulating into a difficult to clean mess. Moreover, containers and other objects frequently fall onto the floor are of the shower area from the lip of the tub, shelves or windowsills where they are usually stored thereby creating a potentially hazardous situation. Many shower organizers are known in the art to alleviate clutter in the shower area. Some of these hang from the showerhead or are hung from suction cups stuck onto the tile. Unfortunately, these shower organizers are unstable and prone to swing when contact is made therewith thereby spilling the contents. Furthermore, the devices of the prior art are often bulky and intrude into an already confined shower area.

The present invention seeks to overcome the shortcomings of the prior art by providing a plurality of dispenser pockets that may be manufactured into a shower curtain or retro fit to an existing curtain so that the contents contained therein are securely maintained therein where they are easily accessible yet out of the way of the person in the shower or tub area. The dispenser pockets are removable for easy cleaning of the curtain and the dispenser pockets as well as refilling said dispenser pockets.

SUMMARY OF THE PRESENT INVENTION

The present invention discloses a standard shower curtain that has a plurality of individual dispensers affixed to the inner side thereof. These dispensers provide means to contain and dispense shampoo, conditioner, liquid soap, and other amenities thus avoiding clutter and soiling around the bathtub or shower stall. The present invention discloses a dispenser pocket which provides means to close and seal the liquid contents within the pocket. The dispenser pocket includes an interlocking seal channel type closing mechanism at the top of the pocket. Once the pocket is filled with desired liquid, the pocket is sealed by pressing a seal channel on each side of the pocket together. A release button attached to the spout at the bottom of the pocket provides means to dispense the liquid contents from the pocket. The button is depressed to allow the liquid contents to be dispensed from the pocket and released to stop the flow.

A primary object of the present invention is to provide a device for retaining and dispensing articles common to a shower area on a shower curtain.

Another object of the present invention is to provide a device for retaining and dispensing articles common to a shower area on a shower curtain in order to reduce clutter therein.

Yet another object of the present invention is to provide a device for retaining and dispensing articles common to a shower area on a shower curtain to reduce the amount of cleaning therein.

Still yet another object of the present invention is to provide a device for retaining and dispensing articles common to a shower area on a shower curtain to provide a safer environment therein.

Another object of the present invention is to provide a device for retaining and dispensing articles common to a shower area on a shower curtain having individual sealable dispensing pouches for shampoo, conditioner, body soap and other like substances.

Yet another object of the present invention is to provide a device for retaining and dispensing articles common to a shower area on a shower curtain having open pouches with drainage means for storing razors, washcloths and other such articles.

Still yet another object of the present invention is to provide a device for retaining and dispensing articles common to a shower area on a shower curtain that is simple and easy to use.

One other object of the present invention is to provide a device for retaining and dispensing articles common to a shower area on a shower curtain that is inexpensive to manufacture and operate.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
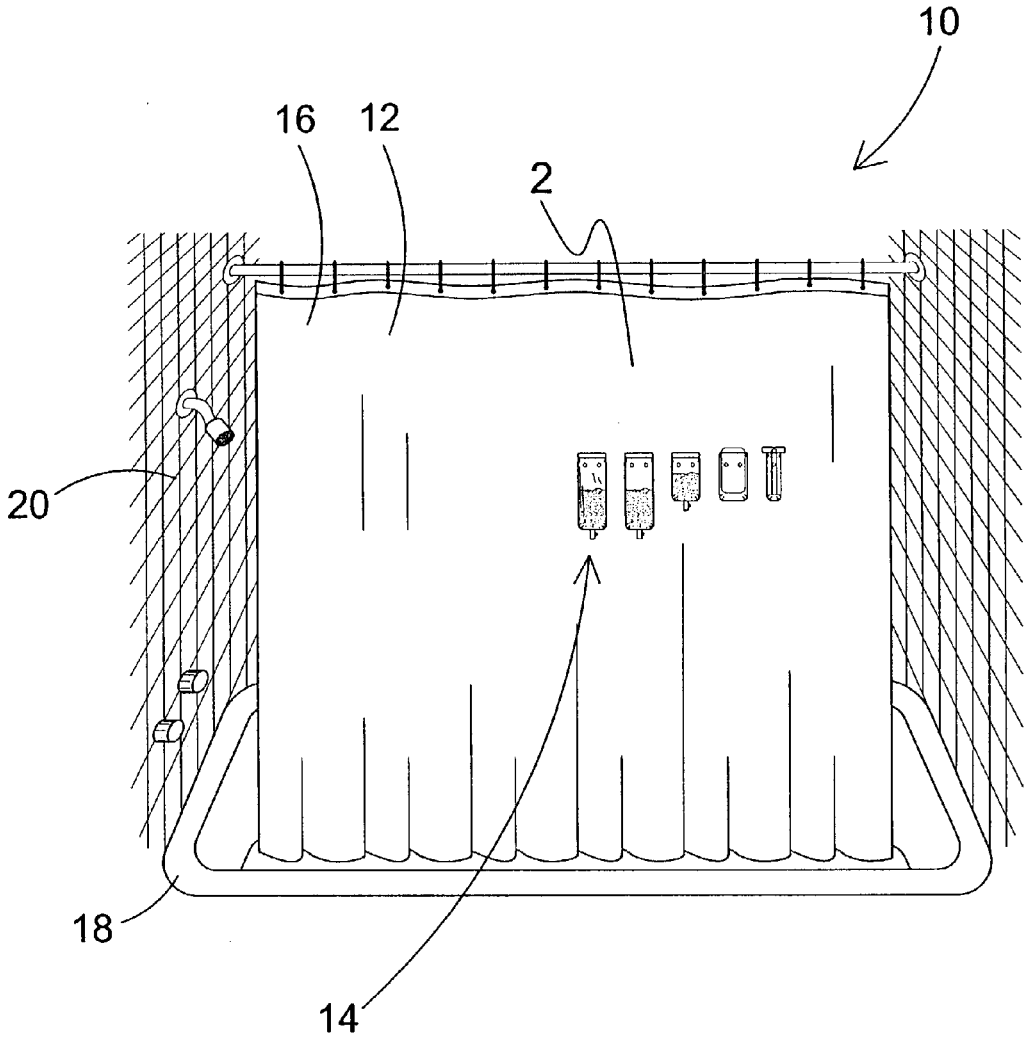
FIG. 1 is an illustrative view of the present invention in use.

With regard to reference numerals used, the following numbering is used throughout the drawings.

10 present invention
12 shower curtain
14 dispenser pockets
16 inner side
18 bath tub
20 shower stall
22 snap button
24 closure means
25 liquid contents
26 release button
28 spout
30 top
32 open top
34 drain holes

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a standard shower curtain 12 that has a plurality of individual dispensers 14 affixed to the inner side 16 thereof. These dispensers 14 provide means to contain and dispense shampoo, conditioner, liquid soap, and other amenities thus avoiding clutter and soiling around the bathtub 18 or shower stall 20.

Figure 2:
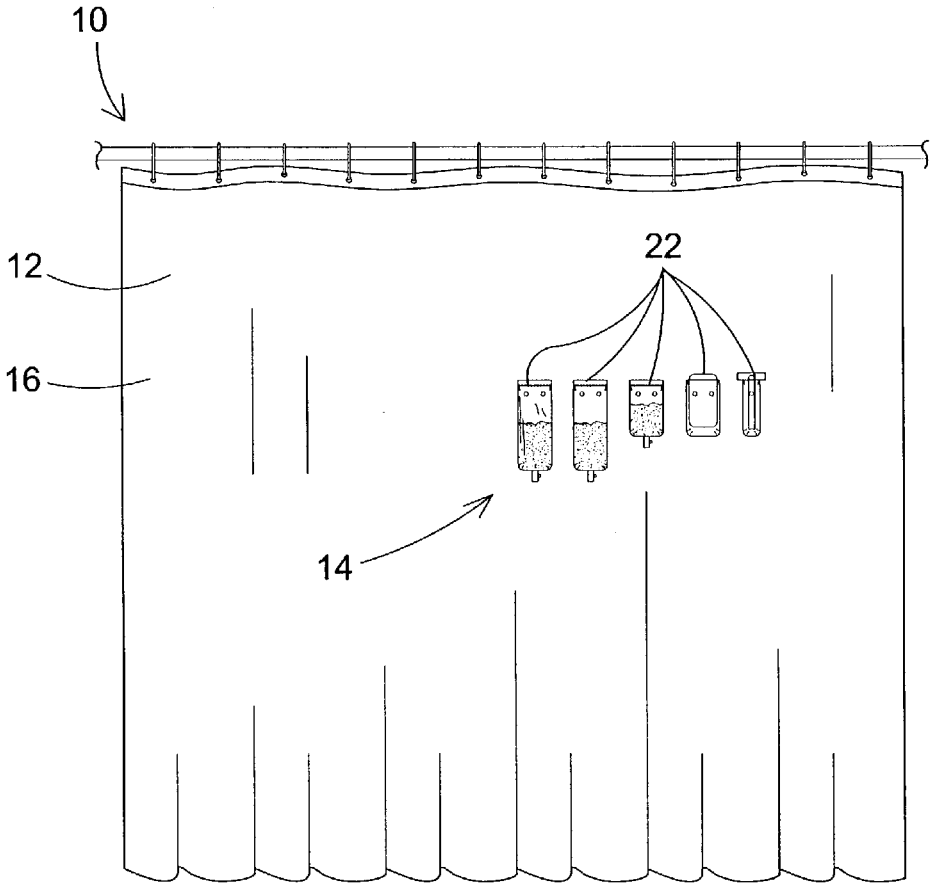
FIG. 2 is a front view of the present invention.

Turning to FIG. 2, shown therein is a perspective view of the present invention 10. The dispenser pockets 14 are attached to the curtain 12 by means of snap buttons 22. One side of the button 22 is affixed to the dispenser pocket 14 and the mating side of the button is affixed to the inner surface 16 of the curtain 12. The pockets 14 are positioned on the curtain 12 to allow easy access to the bathing items. The pockets 14 are of various designs, sizes and shapes to receive different amenities.

Figure 3:
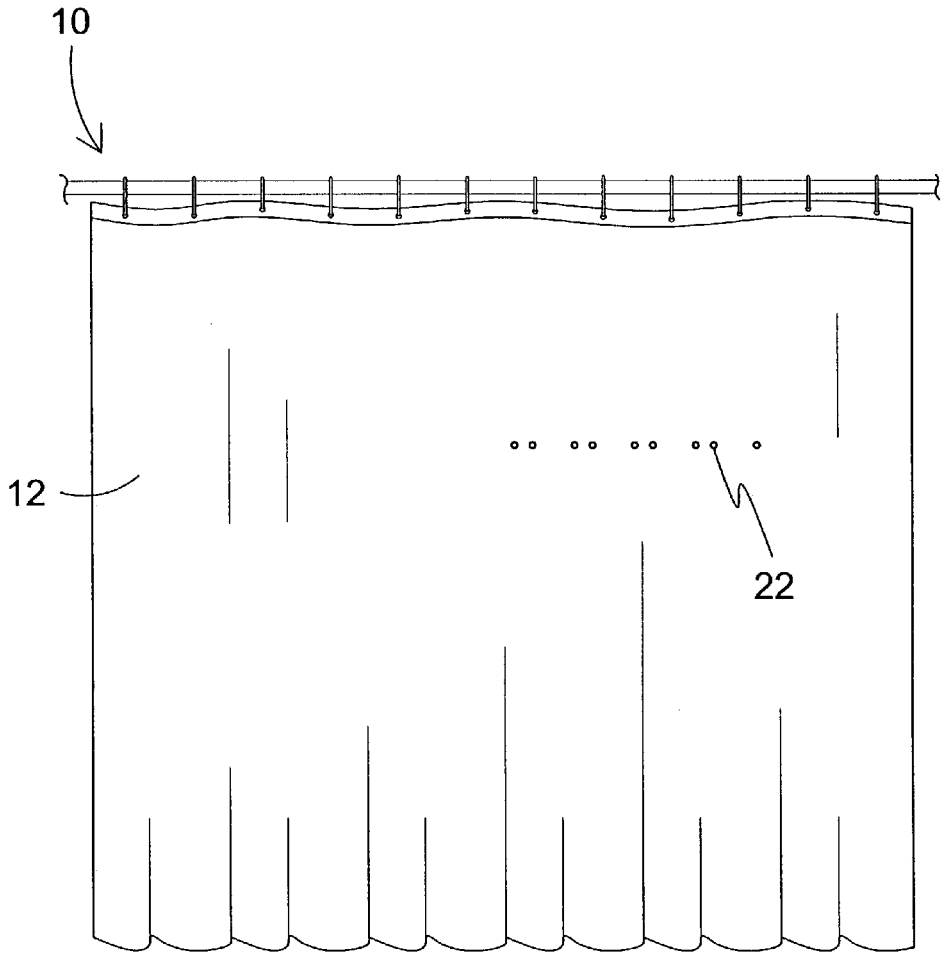
FIG. 3 is a front view of the present invention with the dispenser pockets detached.

Turning to FIG. 3, shown therein is a front view of the present invention 10 with dispenser pockets detached. The dispenser pockets may be detached from the curtain 12 to provide means to clean the individual pockets and the curtain. The plurality of snaps 22 are shown affixed to the curtain 12 at a typical shoulder height, but the snaps may be positioned at any point on the curtain to suit the user's needs.

Figure 4:
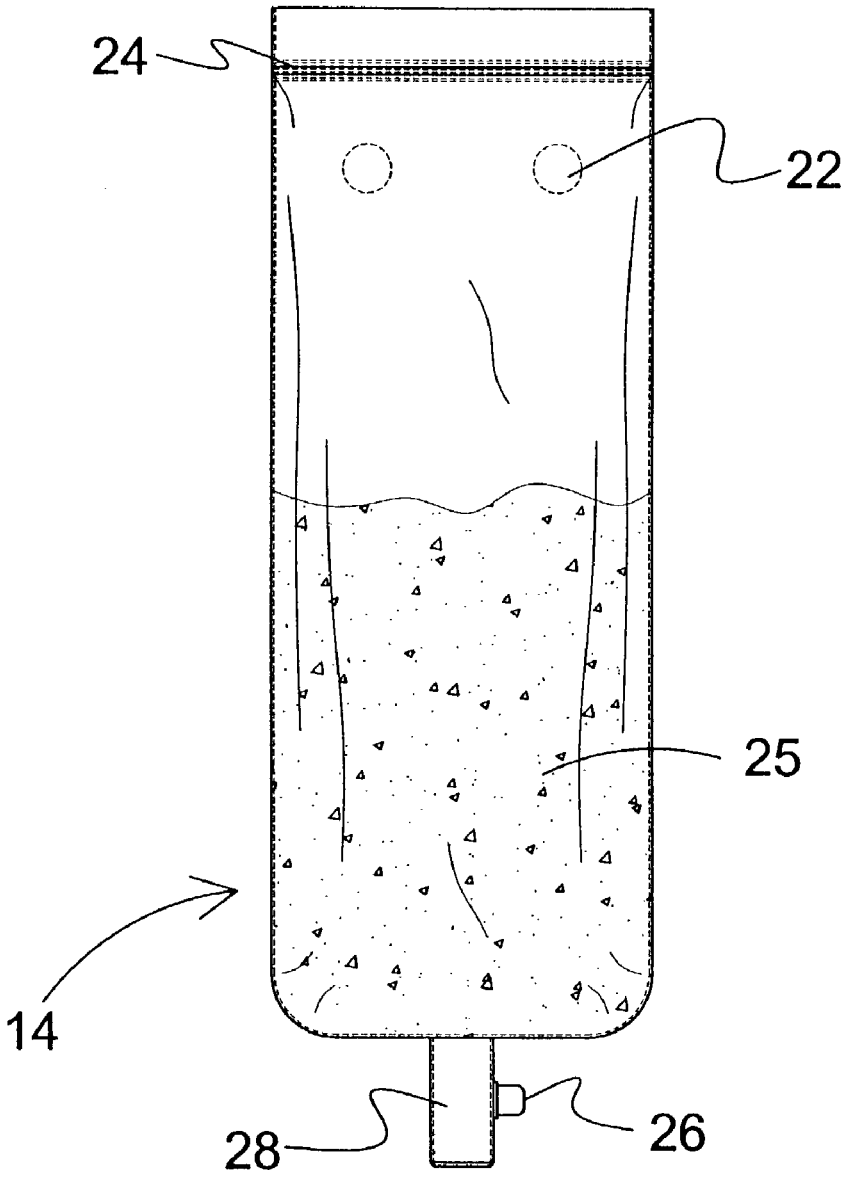
FIG. 4 is a front view of the present invention dispenser pocket with closure means.

Turning to FIG. 4, shown therein is a front view of the dispenser pocket 14 of the present invention with closure means 24. One type of the present invention's dispenser pocket 14 provides means to close 24 and seal the liquid contents 25 within the pocket. The dispenser pocket 14 includes a zip-lock type, i.e., a seal channel, 24 closing mechanism at the top of the pocket. Once the pocket 14 is filled with desired liquid 25, the pocket is sealed by pressing a seal channel 24 on each side of the pocket together. A release button 26 attached to the spout 28 at the bottom of the pocket 14 provides means to dispense the liquid contents 25 from the pocket. The button 26 is depressed to allow the liquid contents 25 to be dispensed from the pocket 14 and released to stop the flow. The snap button 22 is also shown.

Figure 5:
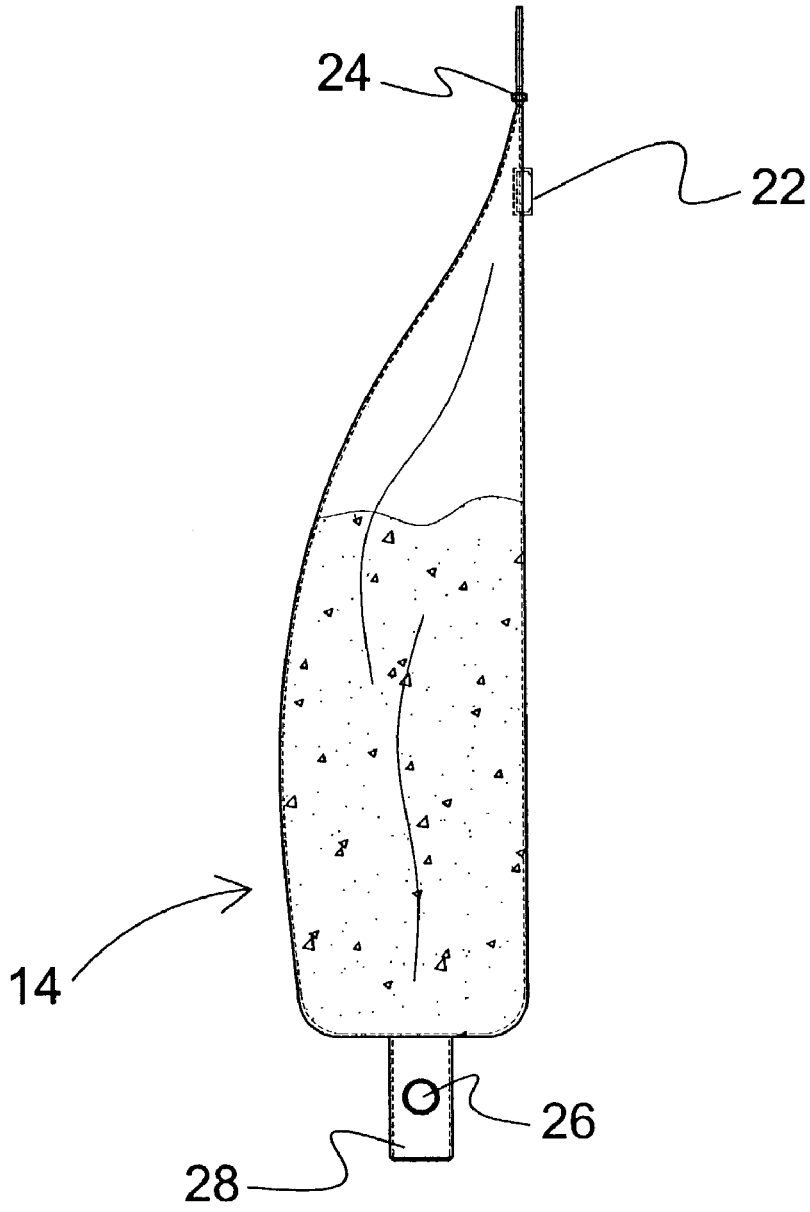
FIG. 5 is a side view of the present invention dispenser pocket with closure means.

Turning to FIG. 5, shown therein is a side view of the dispenser pocket 14 of the present invention with closure means 24. The dispenser pocket 14 is secured to the curtain by a pair of snap buttons 22. One side of the button 22 is affixed to the upper backside of the pocket 14 and the mating side of the button is affixed to the inner side of the curtain. The snap buttons 22 provide easy means to secure and detach the pocket 14 from the curtain. Also shown are the seal channel closure means 24, spout 28 and release button 26.

Figure 6:
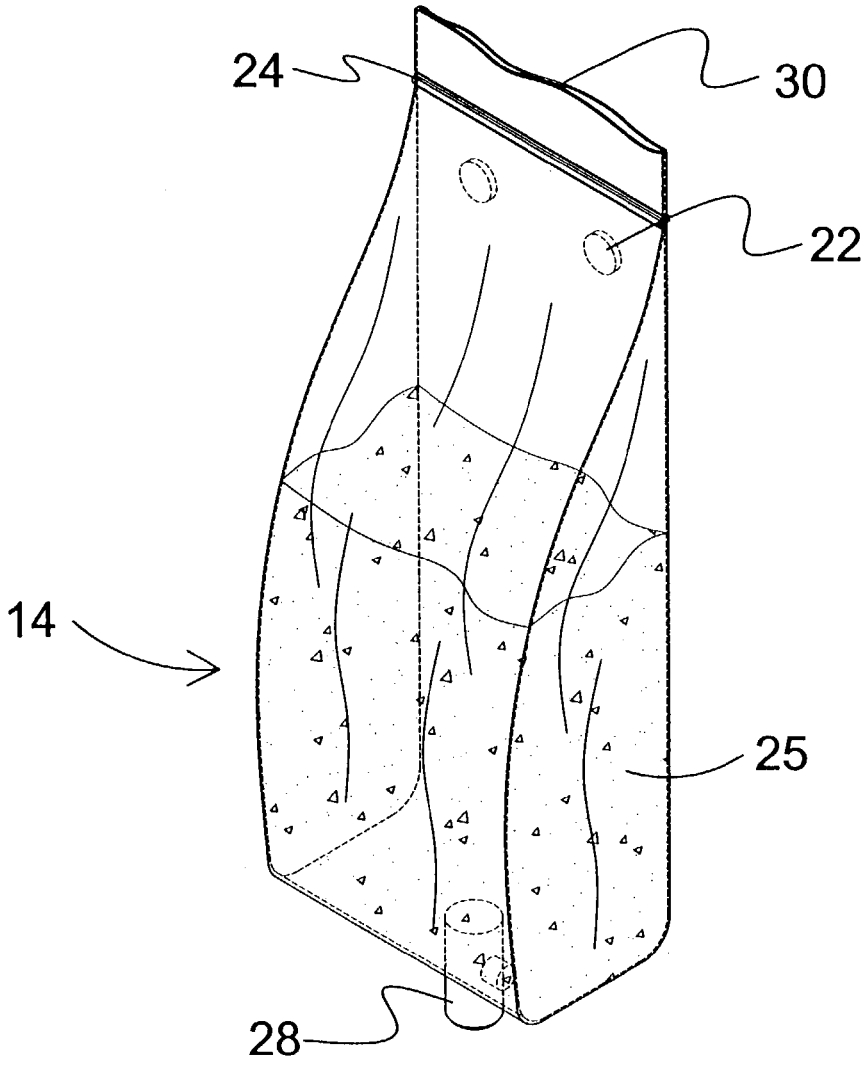
FIG. 6 is an isometric view of the present invention dispenser pocket with closure means.

Turning to FIG. 6, shown therein is an isometric view of the dispenser pocket 14 of the present invention with closure means 24. The dispenser pocket 14 is filled with shampoo or another liquid ingredient 25 through the top 30 of the pocket. The dispenser pocket 14 can be sealed after the contents are added by pressing together the interlocking seal channels 24. When the dispenser pocket 14 is sealed the contents 25 are kept free of contaminates. Also shown are the snap button 22 and spout 28.

Figure 7:
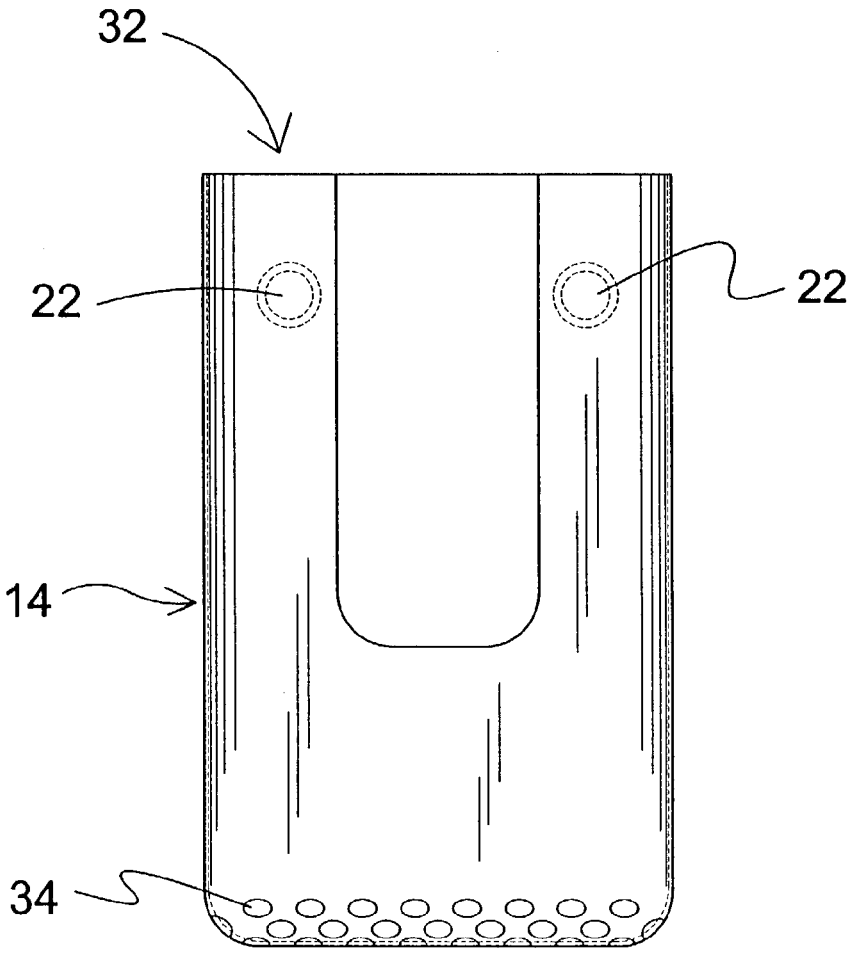
FIG. 7 is a front view of the present invention dispenser pocket with open top.

Turning to FIG. 7, shown therein is a front view of the dispenser pocket 14 of the present invention with an open top 32. Another type of dispenser pocket 14 with an open top 32 is secured to the curtain by a pair of snap buttons 22. This type of dispenser pocket 14 provides means for securing a bar of soap, cloth, or other bath amenity. One side of the button 22 is affixed to the upper backside of the pocket 14 and the mating side of the button is affixed to the curtain. A plurality of drain holes 34 are also shown.

Figure 8:
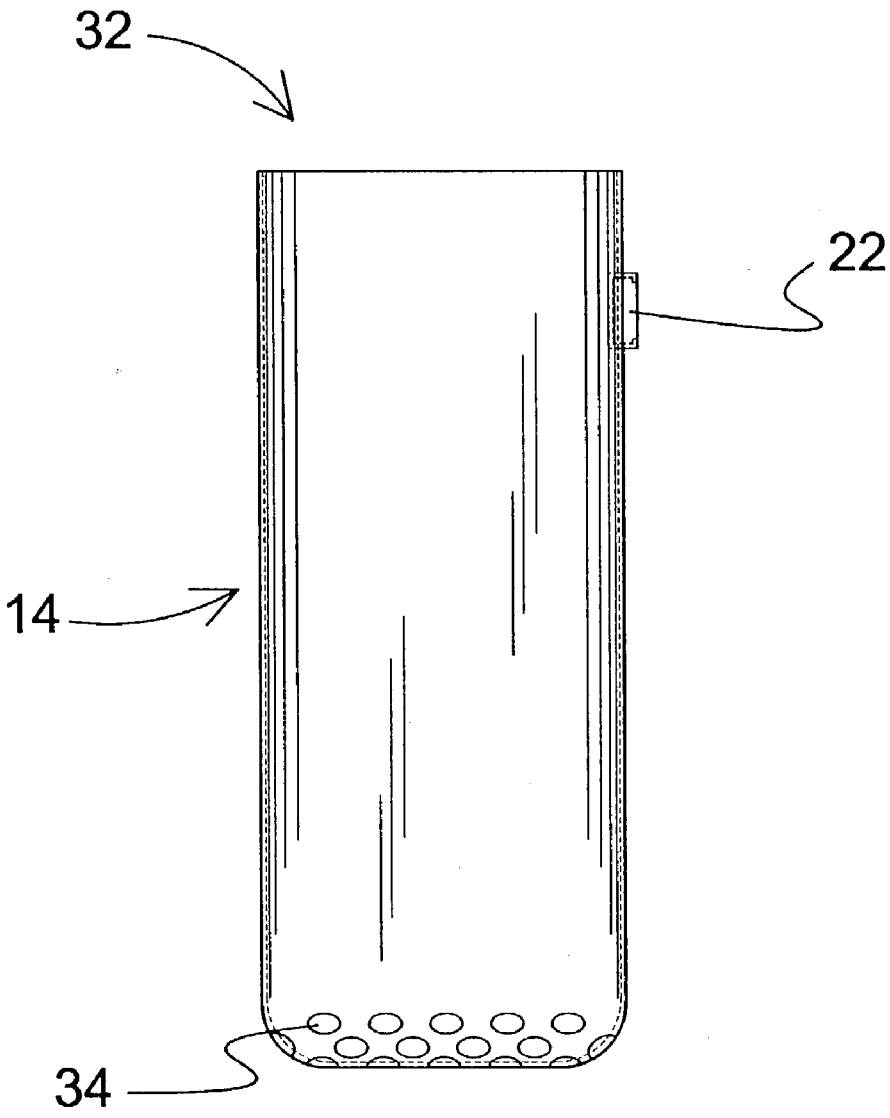
FIG. 8 is a side view of the present invention dispenser pocket with an open top.

Turning to FIG. 8, shown therein is a side view of the dispenser pocket 14 of the present invention with an open top 32. A dispenser pocket 14 with open top 32 provides means for securing a bar of soap, cloth or other bath amenity. A plurality of apertures 34 in the bottom allows water to drain from the dispenser pocket 14 thereby keeping the pocket from retaining dirty water.

Figure 9:
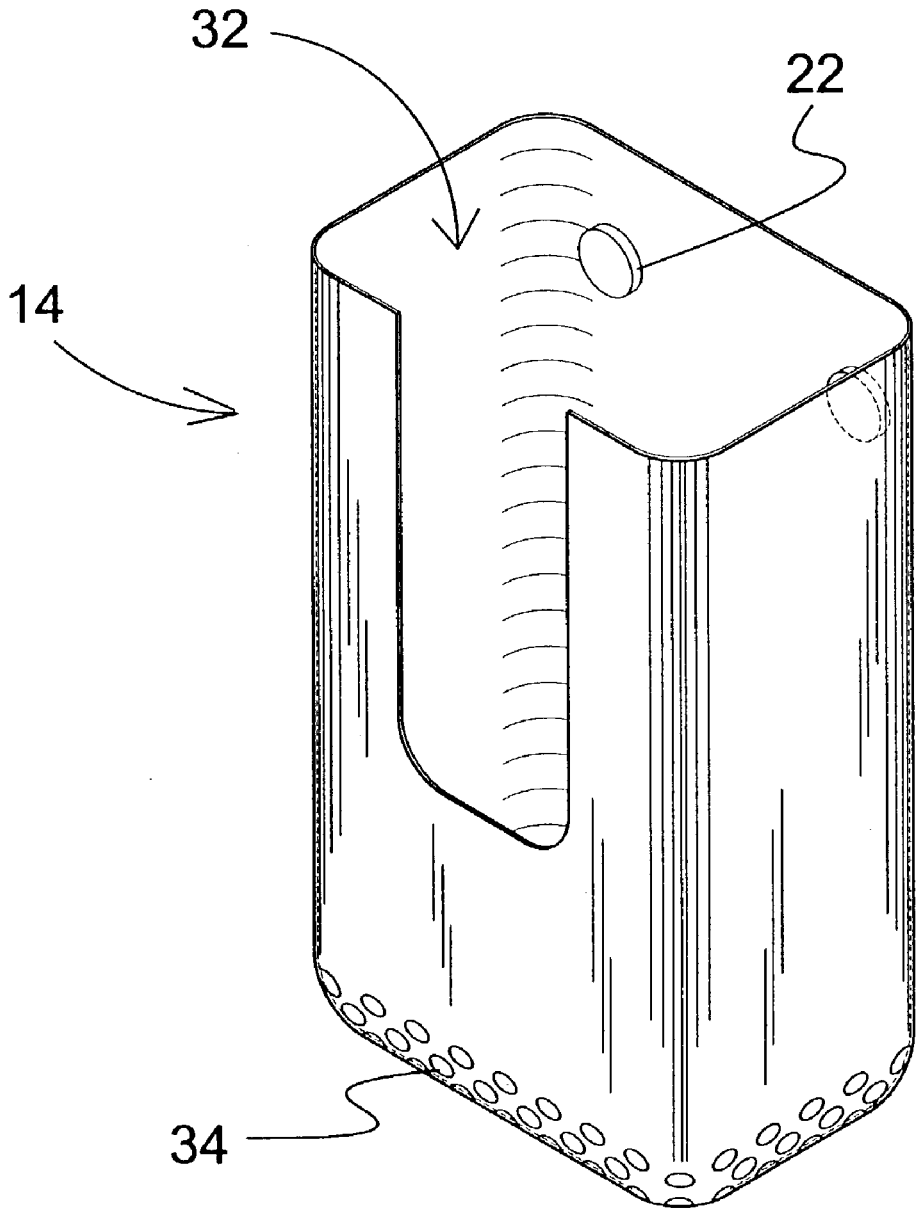
FIG. 9 is an isometric view of the present invention dispenser pocket with an open top.

Turning to FIG. 9, shown therein is an isometric view of the dispenser pocket 14 of the present invention with an open top 32. A dispenser pocket 14 with an open top 32 provides means for securing a bar of soap, cloth or other bath amenity. A plurality of apertures 34 in the bottom surface allows water to drain from the dispenser pocket 14 thereby keeping the pocket from retaining dirty water. The snap buttons 22 are also shown.

Figure 10:
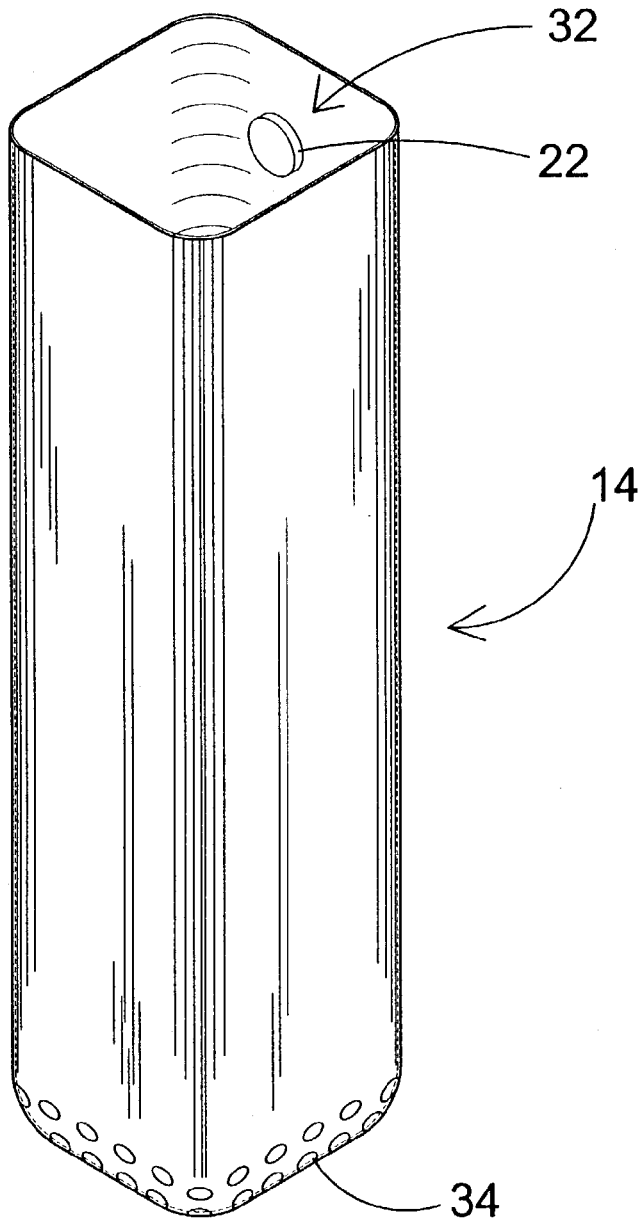
FIG. 10 is an isometric view of the present invention dispenser pocket with an open top.

Turning to FIG. 10, shown therein is an isometric view of the dispenser pocket 14 of the present invention with an open top 32. Depicted is another type of dispenser pocket 14 being elongated with an open top 32. Secured with a single snap button 22, this style dispenser pocket 14 provides means for securing elongated items such a razor or handled device. A plurality of apertures 34 in the bottom surface allows water to drain from the dispenser pocket 14 thereby keeping the pocket from retaining dirty water.

We claim:

1. A removable liquid dispenser for attachment to a shower curtain, the shower curtain for being hung in a shower stall or bath tub, comprising:

a) a shower curtain, said curtain having an inner side, a top, and a bottom for being hung in a shower stall or bath tub;

b) at least one liquid dispenser being disposed on said inner side of said shower curtain to permit a user to have easy access to the dispenser, said dispenser having a top, a bottom, a front side and a back side;

c) means for attaching said dispenser to said shower curtain whereby the dispenser can be removably fixed to the shower curtain; and, d) means for a spout disposed on said bottom of said dispenser whereby the liquid contents of the dispenser can be removed from the dispenser, wherein a plurality of dispensers are disposed on said shower curtain to permit a user to have access to a variety of liquid contents and said means for attaching said dispensers to said shower curtain comprises at least one mating snap button, said snap button having a pair of mating parts, wherein a first mating part is disposed on said inner surface of said shower curtain and a second mating part is disposed on said backside of said dispenser to permit the dispenser to he removably fixed to said shower curtain.

2. The dispenser of claim 1, wherein a plurality of mating snap buttons are used to attach said dispensers to said shower curtain.

3. The dispenser of claim 2, wherein said means for a spout comprises a downwardly extending spout having a release button disposed thereon, wherein said release button releases liquid contents from said dispenser when said release button is pushed to an inward position by a user.

4. The dispenser of claim 3, further comprising means for a reclosable inlet being disposed proximate to said top of said dispenser to permit a user to add liquid to the inside of the dispenser.

5. The dispenser of claim 4, wherein said means for a reclosable inlet comprises a pair of interlocking seal channels, wherein a first member of said pair of seal channels is disposed on said front of said dispenser and a second member of said pair of seal channels is disposed on said back of said dispenser to permit a user to easily open and reseal the interlocking seal channels.

* * * * *